US005893819A

United States Patent [19]

Dunn, Jr. et al.

[11] Patent Number: 5,893,819

[45] Date of Patent: Apr. 13, 1999

[54] RECREATIONAL EQUIPMENT JUNCTION BOX

[75] Inventors: James O. Dunn, Jr., Charlotte; Todd A. Coble, Stanfield, both of N.C.

[73] Assignee: Soft Play L.L.C., Charlotte, N.C.

[21] Appl. No.: 08/832,075

[22] Filed: Apr. 2, 1997

Related U.S. Application Data

[63] Continuation of application No. 08/659,176, Jun. 5, 1996, abandoned.

[51] Int. Cl.[6] ..... A63B 9/00

[52] U.S. Cl. ..... 482/35; 482/36; D21/242

[58] Field of Search ..... 482/35, 36, 23, 482/24; D21/242; 446/7, 85, 89, 476

[56] References Cited

U.S. PATENT DOCUMENTS 5,387,165 2/1995 Warren .
5,540,636 7/1996 Hellen .

FOREIGN PATENT DOCUMENTS

WO9412241 6/1994 WIPO .

*Primary Examiner*—Richard J. Apley
*Assistant Examiner*—William LaMarca
*Attorney, Agent, or Firm*—Polster, Lieder Woodruff & Lucchesi, L.C.

[57] ABSTRACT

A recreational equipment junction box for tubular recreational equipment is disclosed. The junction box is a one-piece molded thin-walled enclosure having a plurality of spaced and opposed sides. At least one side of the enclosure is provided with a closed wall within a tubular ring section of predetermined dimension. The closed wall is capable of being partially removed for receiving a window or capable of being entirely removed for receiving a complementary shaped tube within the tubular ring section for connection to the enclosure. The junction box facilitates the transition of movement in four possible directions, while also enhancing the use of transparent windows in one or more locations as may be desired.

14 Claims, 6 Drawing Sheets

RECREATIONAL EQUIPMENT JUNCTION BOX

This is a continuation of application Ser. No. 08/659,176, filed on Jun. 5, 1996, now abandoned.

BACKGROUND OF THE INVENTION

The present invention relates to an improved recreational equipment junction box, and more particularly, to a one-piece molded enclosure which facilitates the transition of moving in up to four directions, as well as the use of windows and transitional movement in a lesser number of directions, all in a simplified and easy-to-use construction.

U.S. Pat. No. 5,387,165 discloses a recreational equipment junction box for use with tubular recreational play equipment. Such tubular play equipment enables children to move or crawl through elongated tubes and enclosures for a fun play experience. Junction boxes of this type have alleviated the problem associated with children turning the corner or passing one another in the tubular structure. One, two, or three tubes may be attached to the junction box in a variety of angular relationships, enabling the junction box to facilitate movement of children in and through corner areas or other constricted locations. Thus, the conjunction box serves as a useful transitional space or even as an end destination in an enclosed path. Additionally, such junction boxes are conducive to the installation of windows as well as being adaptable to the installation of simulated equipment such as a vehicle cockpit or the like, to enhance the play experience of children.

While the junction box shown in U.S. Pat. No. 5,387,165 has and will continue to serve as a useful transitional component, there has been a need to create a four way junction including one tube extending at a slope, that is, into or out of a climb. There has also been a need to reduce the number of parts required to create the various options afforded by the junction box, including the use of one or more transparent windows or tubes, as may be desired. Accordingly, the present invention seeks to improve the features afforded by the junction box shown in U.S. Pat. No. 5,387,165, as will be further understood by the discussion that follows.

SUMMARY OF THE INVENTION

Among the several objects and advantages of the present invention include:

- The provision of a new and improved recreational equipment box;
- The provision of the aforementioned new and improved recreational equipment box which facilitates the transition of movement in and through corners and other constrictive areas of tubular play equipment;
- The provision of the aforementioned new and improved recreational equipment junction box which includes up to a four way junction, including at a slope, that is, into and out of a climb;
- The provision of the aforementioned new and improved recreational equipment junction box which affords a variety of window or connection tube options;
- The provision of the aforementioned new and improved junction box including molded in window profiles;
- The provision of the new and improved recreational equipment junction box which reduces the number of parts required to create the desired window or connecting tube transition; and

- The provision of the aforementioned new and improved recreational equipment junction box which is made up of a minimum number of parts, is easy to construct by conventional rotational molding techniques; is easily modified to provide the desired window or connecting tube options; is durable and long lasting; and is otherwise well adapted for the purposes intended.

Briefly stated, the recreational equipment junction box of the present invention is constructed for use with tubular recreational equipment. The junction box is a one-piece molded thin-walled enclosure having a plurality of spaced and opposed sides. At least one side of the enclosure having a closed wall within a tubular ring section of predetermined dimension. The closed wall is capable of being partially removed for receiving a window or capable of being entirely removed for receiving a complementary shaped tube or window within the tubular ring section for connection to the enclosure.

A closed wall may be provided within a tubular ring section in each of the plurality of sides of the enclosure with each closed wall capable of being removed for receiving a window or capable of being entirely removed for receiving a complementary shaped tube within the tubular ring section provided in each side of the enclosure. The enclosure may include one curved side in which at least one opening is formed for receiving a window or complementary shaped tube. The elongated side of predetermined dimension enables an opening of predetermined dimension to be formed at various locations for receiving a window or complementary shaped tube that extends at various predetermined angles to the enclosure. The elongated side of predetermined dimension may include a predetermined compound radius curved elongated side.

Each closed wall of the enclosure may be pre-configured in a predetermined shape that extends at least partially outwardly from the tubular ring section. Each pre-configured shape of each closed wall may include a polygonal ring-like element within the tubular ring section and a planer wall within the polygonal ring-like element. A continuous series of polygonal shaped sections may be formed in the polygonal ring-like element of each closed wall.

A pre-formed opening of predetermined dimension is formed in one of the sides of the enclosure for receiving a complementary shaped tube. At least one other side of the enclosure having a closed wall within a tubular ring section of predetermined dimension, each closed wall capable of being partially removed for receiving a window or capable of being entirely removed for receiving a complementary shaped tube or window within the tubular ring section for connection to the enclosure.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

Figure 1:
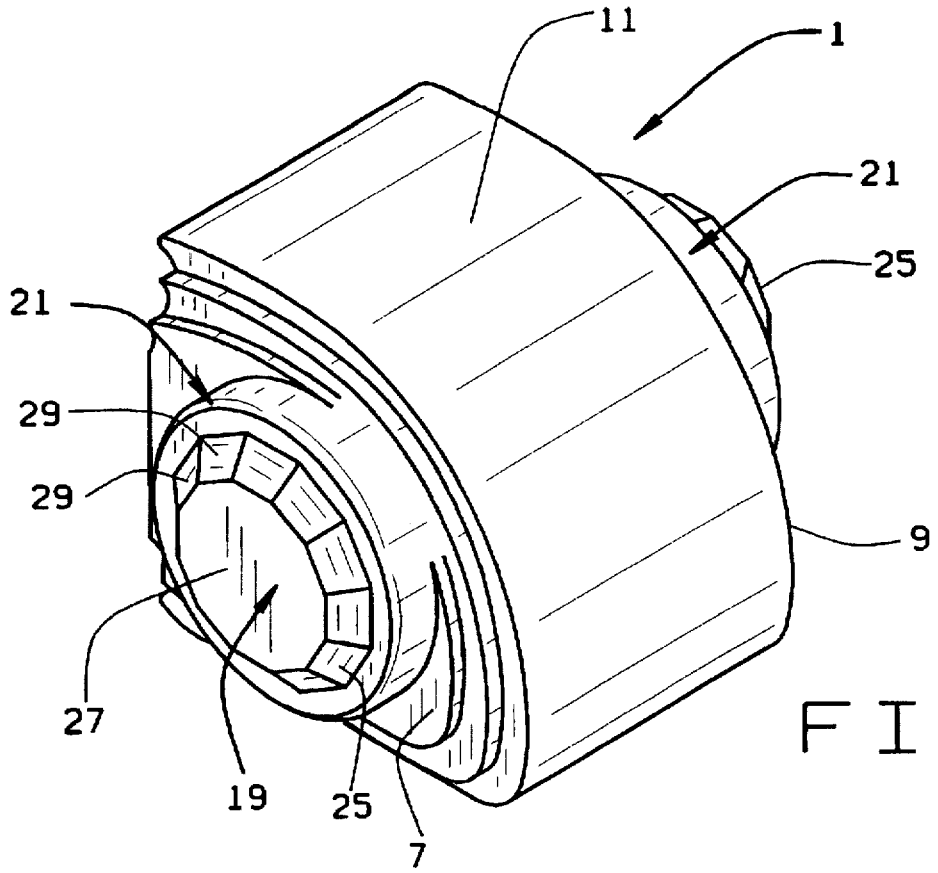
FIG. 1 is a front perspective view of the new and improved recreational equipment junction box of the present invention.

The following detailed description illustrates the invention by way of example and not by way limitation. This description will clearly enable one skilled in the art to make and use the invention, and describes several embodiments, adaptations, variations, alternatives and uses of the invention, including what I presently believe is the best mode of carrying out the invention.

The new and improved recreational equipment junction box of the present invention is used to interconnect as well as enhance the effectiveness of children's tubular play equipment. While employing certain of the features disclosed in U.S. Pat. No. 5,387,165, it will be appreciated that the new and improved features of the present invention make the recreational equipment junction box of the present invention an even more versatile structural component in children's tubular play equipment.

As illustrated in the drawings, the new and improved recreational equipment junction box 1 is a one-piece molded thin-walled enclosure having a plurality of spaced and opposed sides. Preferably, the junction box 1 is rotationally molded using suitable polyethylene resin.

While the junction box 1 is preferably a hollow quarter generally cylindrical-shaped unit having five integrally connected sides, the junction box 1 may be formed in any desired shape and configuration with a plurality of spaced and opposed sides. In the illustrated embodiment, the five integrally connected sides of the hollow generally quarter generally cylindrically-shaped junction box 1 includes two generally transversely extending sides 3, 5, the side 3 also serving as a bottom wall of the junction box 1. Connected to each of the generally transversely extending sides 3, 5 are two generally opposed sides 7, 9, with a fifth side 11 constituting an elongated side of predetermined dimension shown to have a generally curvilinear configuration, the latter elongated side 11 being connected to the various other sides of the junction box 1, as illustrated.

Figure 11:
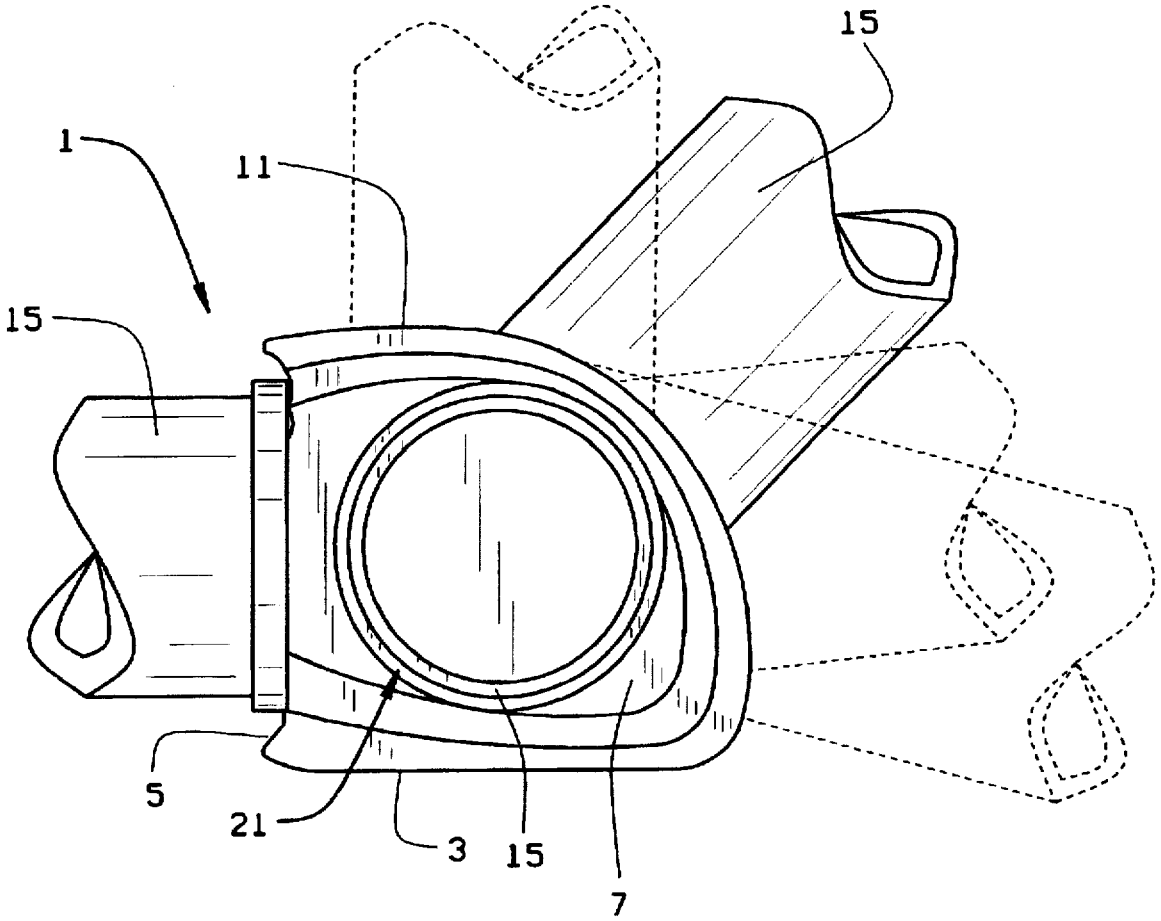
FIG. 11 is a side elevational view, partly in section and partly in phantom lines, illustrating several different slopes into and out of a climb through the elongated curvilinear side of predetermined dimension provided in the junction box of the present invention.

The junction box 1 preferably includes a pre-formed opening 13 of predetermined dimension formed in the side 5 for receiving a complementary shaped tube 15 as shown in FIGS. 71–11 of the drawings. For this purpose, the side 5 of the junction box 1 includes an integral tubular connected neck 17 of predetermined configuration for receiving the complementary shaped tube 15 within the opening 13. Suitable fasteners such as bolts (not shown) are used in securing the tubular connective neck 17 to the complementary shaped tube 15 at its outer peripheral edge or margin.

If desired, the junction box 1 can be used with the complementary shaped tube 15 connected to it, and thus serve as an end destination of an enclosed path in tubular play equipment. However, in most instances, the junction box 1 is used to provide a two, or three, or four-way junction connection in tubular play equipment, with or without transparent windows inserted into various openings formed or cut into the junction box 1, as will become apparent.

Figure 5:
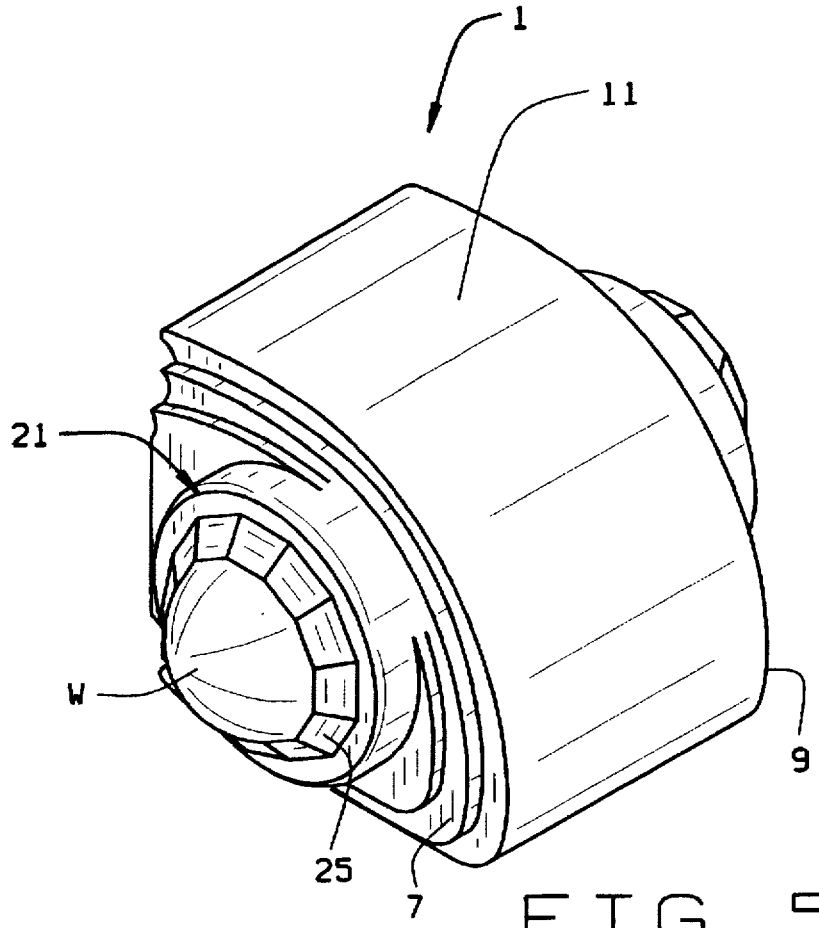
FIG. 5 is a perspective view of the junction box of the present invention with a window formed in one pre-configured side of the junction box.
Figure 6:
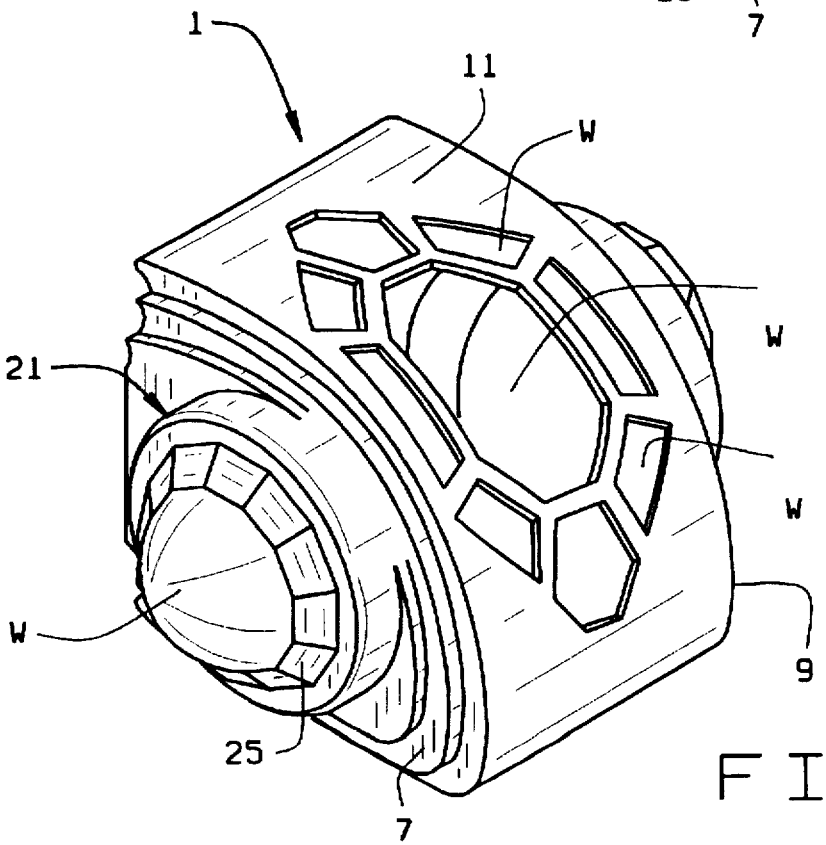
FIG. 6 is a perspective view illustrating windows formed in the elongated curvilinear side of predetermined dimension as well as the pre-configured side of the junction box.
Figure 7:
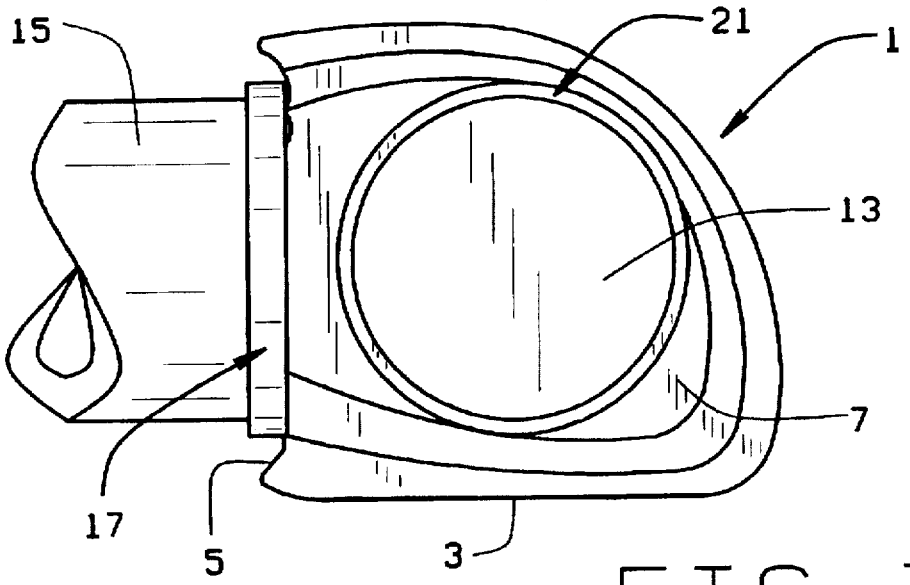
FIG. 7 is a side elevational view, partly in section, illustrating the removal of a closed wall in a tubular ring section in one side of the enclosure for receiving a complementary shaped tube to provide a two way junction for the junction box of the present invention.

To provide multiple tubular connections and/or windows in the junction box 1, opposed sides 7, 9 are preferably each provided with a pre-configured closed wall 19 within a tubular ring section 21 of predetermined dimension. The closed wall 19 is capable of being partially removed, as illustrated in FIGS. 5 and 6, for receiving a transparent window W, or entirely removed for receiving a complementary shaped tube 15 within the tubular ring section 21. Thus, the tubular ring section 21 has the same predetermined dimension as the tubular connective neck 17 to provide an opening 13 (see FIGS. 2 and 7) of the same predetermined size as the opening 13 in the integral connective neck 17, for receiving a complementary shaped tube 15, as illustrated in FIGS. 8–11.

Figure 8:
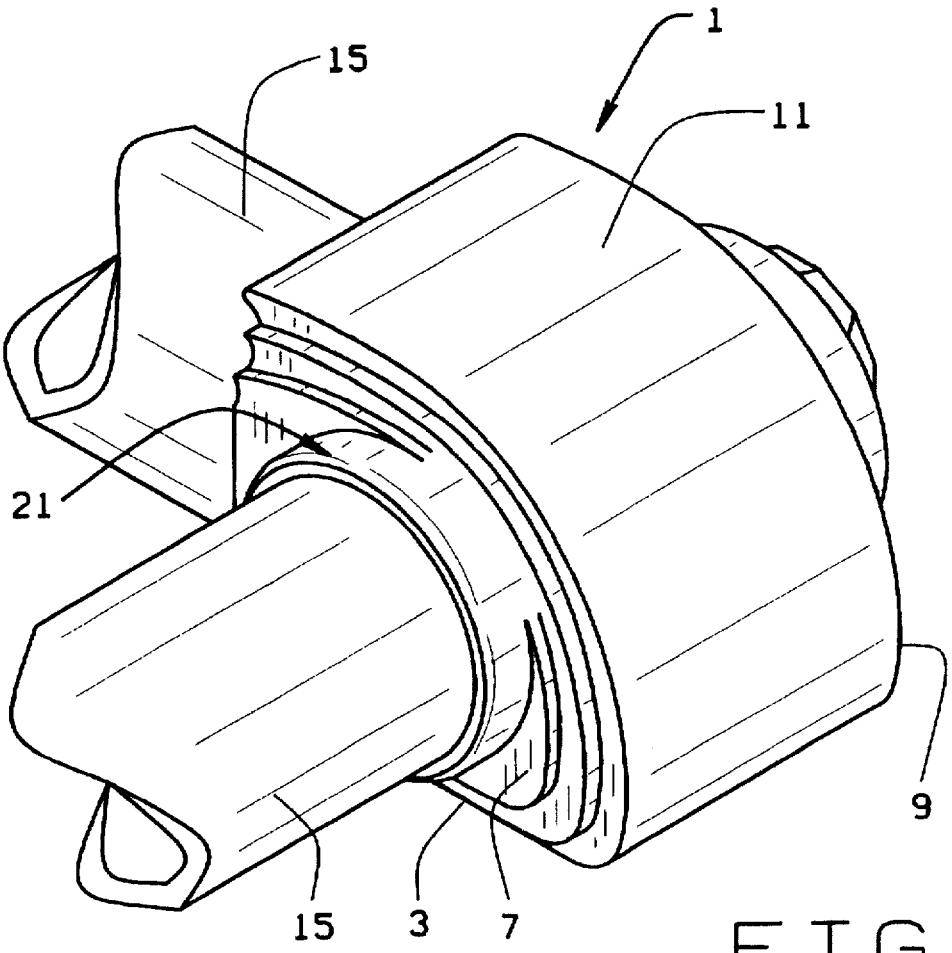
FIG. 8 is a perspective view of the junction box of the present invention with a two-way junction connection.
Figure 9:
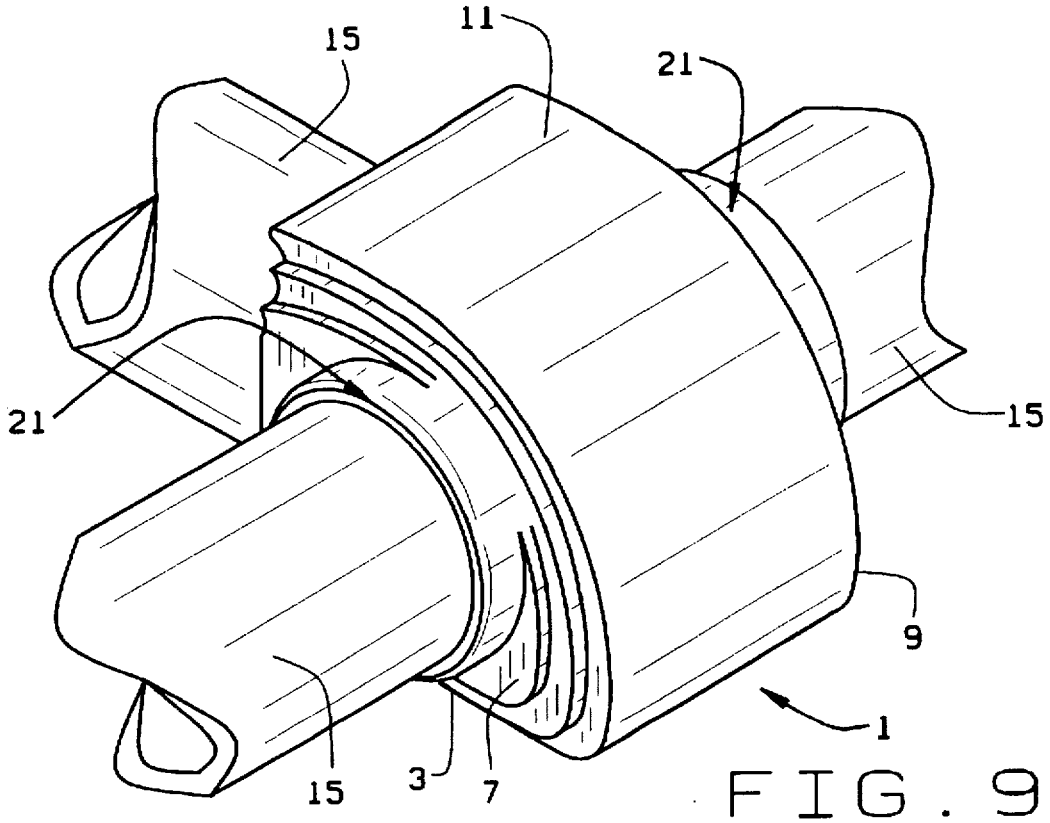
FIG. 9 is a perspective view of the junction box of the present invention with a three-way junction illustrated.

One or both of the pre-configured closed walls 19 within the tubular ring section 21 of the opposed sides 7, 9, may be removed, if desired, for a two-way junction at right angles to each other. Removal of each pre-configured closed wall 19 provides a tubular ring section 21 for receiving the complementary shape tube 15, as illustrated in FIG. 8 of the drawings. FIG. 9 illustrates a three-way junction in which both of the pre-configured closed walls 19, 19 are removed for receiving the complementary shaped tubes 15, 15 within the tubular ring sections 21, 21, as illustrated.

Figure 10:
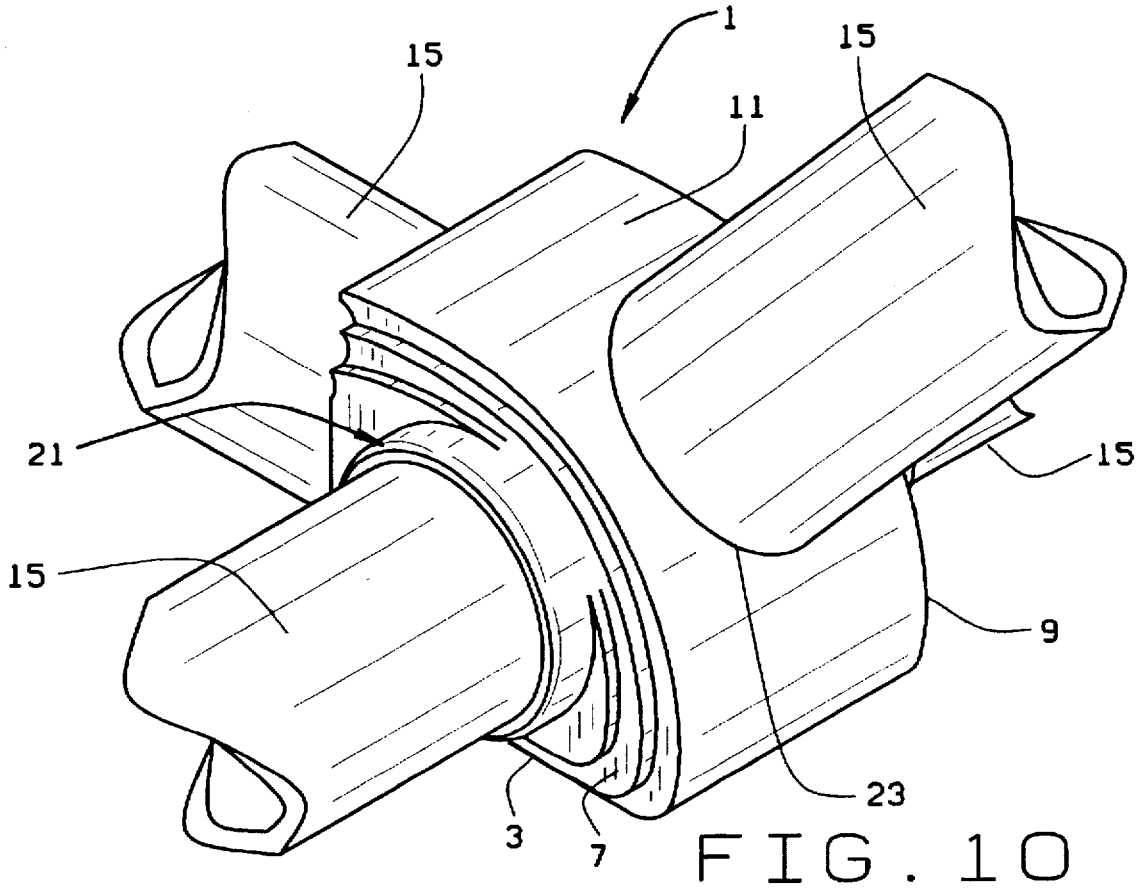
FIG. 10 is a perspective view, partly in section, of the junction box of the present invention, and illustrating a four-way junction with associated complementary shaped tubes.

For a four-way junction box 1, an opening 23, of the same dimension as the openings 13, is formed in the elongated side 11, as shown in FIG. 10 of the drawings. The elongated side 11 is illustrated as being generally curvilinear in shape, and preferably has a predetermined compound radius curve, in order to form the opening 23 in various predetermined positions along the compound radius curved side 11. Thus, complementary shaped tubes 15 can extend at various angles to the junction box 1, as illustrated in FIG. 11 of the drawings. As shown, the various dotted line positions of the complementary shaped tube 15 illustrate the mounting of the complementary shaped tube 15 within the opening 23 at various positions along the compound radius curved side 11. It will be noted that the complementary shaped tube 15 is shown as extending both upwardly as well as downwardly to provide an exit for the junction box 1 either extending into or out of a climb. As a result, the transition of movement may be sloping upwardly or downwardly away from the junction box 1, depending upon the location of the opening 23 formed in the compound radius curved side 11.

Figure 4:
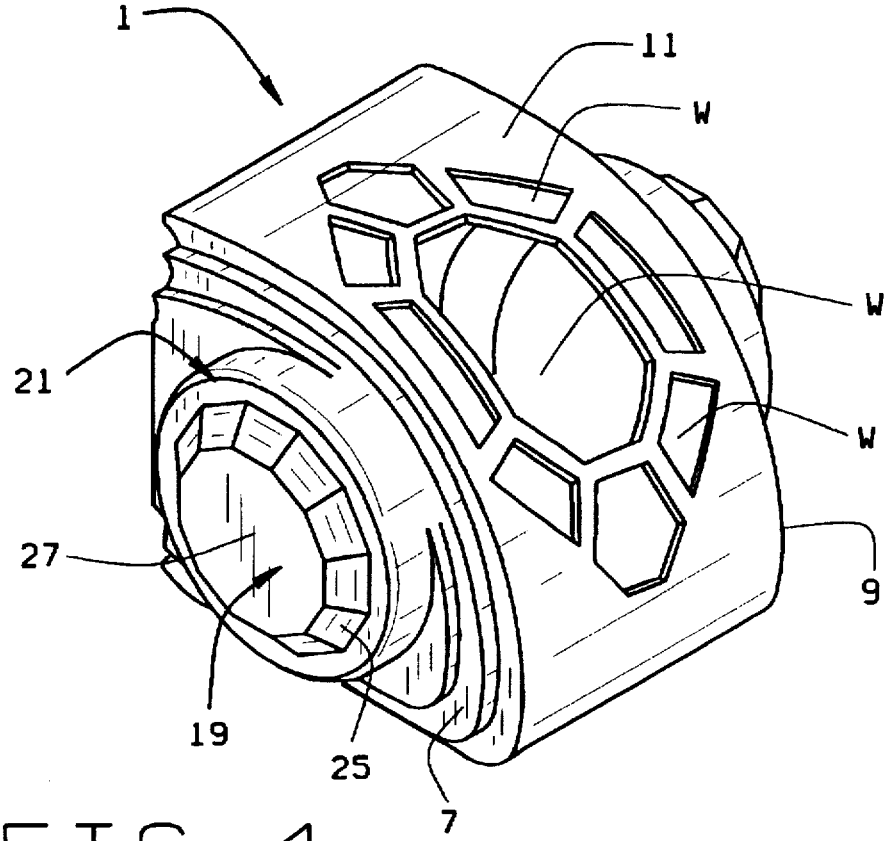
FIG. 4 is a perspective view of the junction box of the present invention illustrating one or more windows formed in any elongated curvilinear side of predetermined dimension provided in the junction box of the present invention.

In lieu of tubular connections, the junction box 1 may provide windows within the opposed sides 7, 9, or the elongated curvilinear side 11 of predetermined dimension. As illustrated in FIG. 4 of the drawings, one or more windows W of various predetermined configuration and location may be formed in the elongated curved side 11. FIG. 5 illustrates part of the pre-configured closed wall 19 as being removed from one side 7 of the junction box 1 for receiving the transparent window W. FIGS. 4 and 5 illustrate windows W formed in the elongated curved side 11 as well as one of the opposed sides 7 of the junction box.

Figure 2:
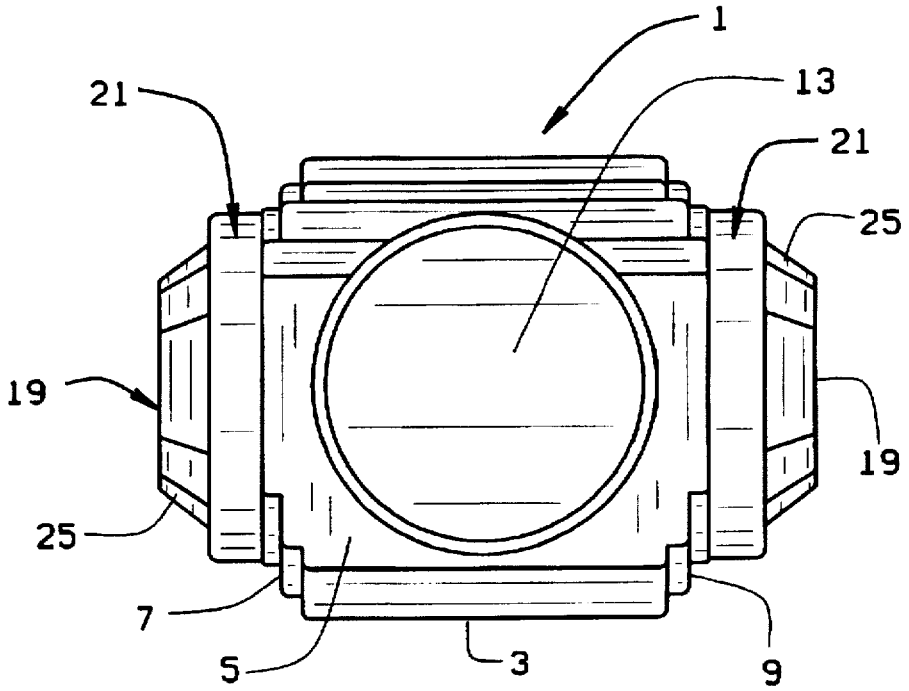
FIG. 2 is a bottom plan view of the junction box of the present invention.
Figure 3:
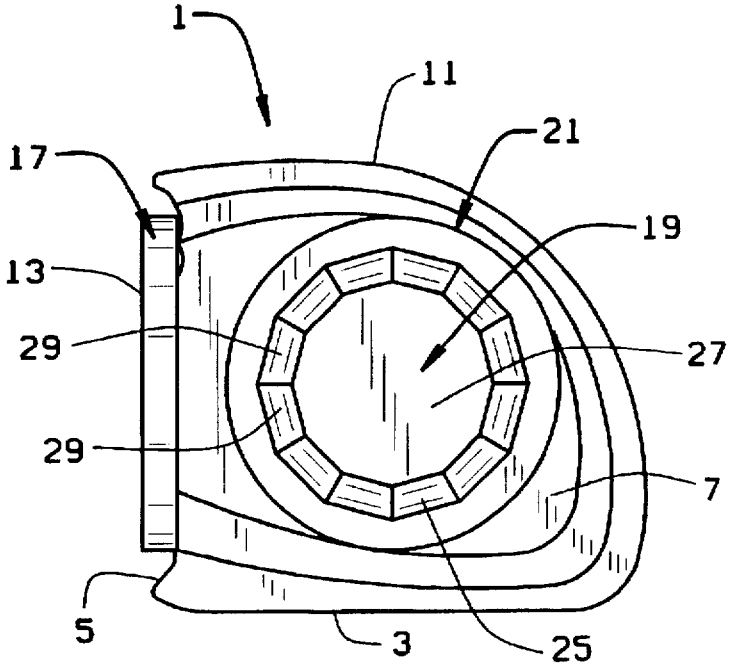
FIG. 3 is a side elevational view of the junction box of the present invention.

It will be noted that the pre-configured closed wall 19 within the tubular ring section 21 of each opposed side wall 7, 9 has a shape that extends at least partially outwardly from the tubular ring section 21, as best illustrated in FIG. 2 of the drawings. Thus, a window profile is molded in the pre-configured outwardly extending closed wall 19 within the tubular ring section 21. Specifically, the pre-configured shape of each closed wall 19 includes a polygonal ring-like element 25 within the tubular ring section 21 including a planer wall 27 within the polygonal ring-like element 25. Each of the polygonal ring-like elements are formed by a continuous series of polygonal shaped sections 29 which are formed in the polygonally ring-like element 25 of each closed wall 19.

Of course, the pre-configured closed wall 19 may have any desired shape, including a planer wall section within the tubular ring section or any other pre-configured outwardly extending shape within the tubular ring section 21, as may be desired.

From the foregoing, it will now be appreciated that the new and improved recreational equipment junction box of the present invention is particularly adaptable for use with children's tubular recreational equipment. The junction box 1 can be used as an end destination of an enclosed path, or more typically, as a two, three, or even four-way junction box for interconnected tubing. One of the junctions may slope upwardly or downwardly away from the junction box in order to create a transition of movement into and out of a climb, as may be desired. The junction box may also be used with one or more transparent windows in one or more sides, depending upon the installation. The pre-configured molded in profile of a window in opposed sides of the enclosure, that is provided within a tubular ring section, can be partially removed for the insertion of a transparent window or completely removed in order to enable a window or complementary shaped tubes to be received within each tubular ring section in one or both opposed sides of the enclosure. As a result, the new and improved recreational junction box of the present invention represents a unique and versatile component that enhances the manufacture of such enclosure in a variety of different end applications as well as the effectiveness of tubular recreational equipment with which it is used.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A recreational equipment junction box providing up to a four-way junction for tubular recreational equipment, comprising:

a one piece molded thin-walled enclosure having a plurality of spaced and opposed sides;

a pre formed opening of predetermined dimension in one of the sides for receiving a complementary shaped tube;

opposed sides of the enclosure adjacent the pre formed opening each having a closed wall within a tubular ring section of predetermined dimension, each closed wall capable of being partially removed for receiving a window or capable of being entirely removed for receiving a complementary shaped tube or window within a respective tubular ring section in one or both of the opposed sides of the enclosure; and an elongated side of predetermined dimension generally opposing the side of the enclosure containing the pre-formed opening, the elongated side having a predetermined compound radius curved shape including a plurality of curved sections of different compound radius curved shape and an opening of predetermined dimension formed in at least one of the curved sections of different compound radius curved shape, the opening extending generally upwardly or downwardly at a different location and angle relative to the enclosure depending on the at least one curved section of different compound radius curved shape that is selected, wherein said angle is defined by a range up to and exceeding 90 degrees, for receiving a window or a complementary shaped tube in order to enable such window or complementary shaped tube to also extend generally upwardly or downwardly at various said angles relative to the enclosure.

2. A recreational equipment junction box providing up to a four way junction for tubular recreational equipment, comprising:

a one piece molded thin-walled enclosure having a plurality of spaced and opposed sides;

a pre formed opening of predetermined dimension in one of the sides for receiving a complementary shaped tube;

an elongated side of predetermined dimension in one of the sides for receiving a complementary shaped tube;

an elongated side of predetermined dimension generally opposing the side of the enclosure containing the pre-formed opening, the elongated side having a predetermined compound radius curved shape including a plurality of curved sections of different compound radius shape and an opening of predetermined dimension formed in at least one of the curved sections of different compound radius curved shape, the opening extending generally upwardly or downwardly at a different location and angle relative to the enclosure depending on the at least one curved section of different compound radius curved shape that is selected for receiving a window or a complementary shaped tube in order to enable such window or complementary shaped tube to also extend generally upwardly or downwardly at various predetermined angles relative to the enclosure, wherein said predetermined angles are defined by a range up to and exceeding 90 degrees.

3. A recreational equipment junction box for tubular recreational equipment, comprising:

a one-piece molded thin-walled enclosure having a plurality of spaced and opposed sides; and at least one side of the enclosure having a closed wall within a laterally outer extending tubular ring section of predetermined dimension, the closed wall having an outer peripheral section which extends laterally outwardly beyond the laterally outwardly extending tubular ring section and an inner planar wall section that extends generally transversely to the laterally outwardly extending tubular ring section, the inner planar wall section of the closed wall capable of being partially removed for receiving a window or the outer peripheral section and the inner planar section of the closed wall capable of being entirely removed for receiving a window or complementary shaped tube within the laterally outwardly extending tubular ring section for connection to the enclosure.

4. The recreational equipment junction box as defined in claim 3 and including a closed wall within a tubular wall section in each of a plurality of sides of the enclosure, each closed wall including an inner planar wall section capable of being partially removed for receiving a window or the outer peripheral section and inner planar wall section of the closed wall both being capable of being entirely removed for receiving a window or complementary shaped tube within the tubular ring section provided in each such side of the enclosure.

5. The recreational equipment junction box as defined in claim 3 including one curved side in which at least one opening is formed for receiving a window or complementary shaped tube.

6. The recreational equipment junction box as defined in claim 5 in which the curved side has a predetermined compound radius curved shape to enable openings to be formed at various selected locations for receiving complementary shaped tubes extending at various predetermined angles to the enclosure.

7. The recreational equipment junction box as defined in claim 6 in which the pre-configured shape of each outer peripheral section of the closed wall includes a polygonal ring-like element within the tubular ring section while the inner planar wall section extends within the polygonal ring-like element.

8. The recreational equipment junction box as defined in claim 7 in which a continuous series of polygonal shaped sections are formed in the polygonal ring-like element of each closed wall.

9. The recreational equipment junction box as defined in claim 8 and including a plurality of opposed sides of the enclosure each being provided with an inner planar wall section surrounded by a polygonal ring-like element that extends within and laterally outwardly beyond the tubular ring section.

10. A recreational equipment junction box for tubular recreational equipment comprising:

a one-piece molded thin-walled enclosure having a plurality of spaced and opposed sides;

a pre-formed opening of predetermined dimension in one of the sides of the enclosure for receiving a complementary shaped tube; and at least one other side of the enclosure having a closed wall within a laterally outwardly extending tubular ring section of predetermined dimension, the closed wall having an outer peripheral section which extends laterally outwardly beyond the laterally outwardly extending tubular ring section and an inner planar wall section that extends generally transversely to the laterally outwardly extending tubular ring section, each closed wall capable of having the inner planar wall section partially removed for receiving a window or capable of having the outer peripheral section and inner planar wall section of the closed wall entirely removed for receiving a window or complementary shaped tube within the laterally outwardly extending tubular ring section for connection to the enclosure.

11. The recreational equipment junction box as defined in claim 10 and including a tubular ring section of predetermined dimension which surrounds the pre-formed opening.

12. The recreational equipment junction box as defined in claim 10 and including opposed sides of the enclosure adjacent the pre-formed opening each being provided with a closed wall within a laterally outwardly extending tubular ring section of predetermined dimension, one or both of the inner planar wall sections of both closed walls capable of being partially removed for receiving a window or the outer peripheral ring and inner planar wall section of both closed walls capable of being entirely removed for receiving a window or complementary shaped tube within the tubular ring section in one or both opposed sides of the enclosure.

13. The recreational equipment junction box as defined in claim 10 and including a predetermined compound radius curved side in general opposition to the pre-formed opening, and an opening of predetermined dimension capable of being formed at various predetermined locations and at various selected angles in the compound radius curved side for receiving a window or complementary shaped tube.

14. The recreational equipment junction box as defined in claim 13 in which the predetermined dimension of the performed opening and subsequent openings formed in the enclosure have the same internal dimension for receiving complementary shaped tubes of the same external dimension.

* * * * *